US005137476A

United States Patent [19]

Noble

[11] Patent Number: 5,137,476

[45] Date of Patent: Aug. 11, 1992

[54] ELECTRICAL CONNECTORS

[76] Inventor: John R. Noble, 419 E. 16th St., Gibson City, Ill. 60936

[21] Appl. No.: 697,758

[22] Filed: May 9, 1991

[51] Int. Cl.[5] ..... H01R 11/09

[52] U.S. Cl. ..... 439/797; 439/810; 439/805; 439/793

[58] Field of Search ..... 439/784, 790, 791, 793, 439/796, 797, 805, 810

[56] References Cited

U.S. PATENT DOCUMENTS

| | | | |
|---|---|---|---|
| Re. 28,877 | 6/1976 | Pertuit | 439/797 |
| 270,478 | 1/1883 | Pumphrey | 439/784 |
| 1,642,345 | 9/1927 | Telford | 439/797 |
| 2,083,606 | 6/1937 | Johansson | 439/791 |
| 3,864,013 | 2/1975 | Levy | 439/797 |
| 4,303,295 | 12/1981 | Schreder | 439/359 |
| 4,547,627 | 10/1985 | McGrane | 439/793 |

*Primary Examiner*—Paula A. Bradley
*Attorney, Agent, or Firm*—Lockwood, Alex, FitzGibbon & Cummings

[57] ABSTRACT

The present invention relates to an electrical connector for coupling together at least two electrical conductors in electrically conductive relationship to each other. The connector has an elongate hollow tubular conductive sleeve in which the conductors are inserted to be coupled. At least one radial aperture extends through the sleeve, and a fastening means extends through the aperture for fastening the conductors in the hollow tubular sleeve by pressing the conductors against the interior surface of the sleeve. An electrically insulative coating covering substantially the entire exterior surface of the sleeve eliminates the potential for electrical shock.

21 Claims, 1 Drawing Sheet

ELECTRICAL CONNECTORS

BACKGROUND AND SUMMARY OF THE INVENTION

The present invention is directed to an electrical connector and, more particularly, to a connector for coupling together at least two electrical conductors in an electrically conductive relationship.

Electrical connectors are known in the art which include conventional wire nut or screw-type connectors. These connectors generally have a conical-shaped plastic housing with a ribbed or threaded metal insert on the inside of the plastic housing. Electrical conductors are generally pigtailed with one another, inserted into the wire nut connector and then rotated therein so as to make a good contact with each other and with the metal surfaces on the inside of the plastic housing.

These prior electrical connectors suffer several disadvantages. One disadvantage is the labor intensive step of pigtailing the electrical conductors before inserting them into the wire nut. Another disadvantage is that the electrical wires must be carefully inserted into the wire nut to ensure that the wire nut tightly grips the electrical conductors. Another disadvantage of wire nut connectors is that repeated connection and disconnection of the electrical conductors from the wire nut connector may cause the electrical conductors to become frayed and to possibly break off. Still another disadvantage is that these connectors are generally somewhat bulky.

To overcome these disadvantages of conventional wire nut connectors, crimp-type electrical connectors were developed. In a crimp-type connector, a generally cylindrical sleeve, after receiving the electrical conductors, is crimped at each end so that the electrical conductors are crimped between opposite walls of the sleeve.

While these prior crimp-type electrical connectors overcome some of the disadvantages of the prior conventional wire nut connectors, they also suffer from several disadvantages. One such disadvantage is the need for the use of a special crimping tool to crimp the sleeve ends. Not only is the tool required, but it is large and difficult to manipulate in confined spaces. Another disadvantage is that the electrical conductors must be cut to remove them from the crimp-type connector. This may necessitate the labor intensive step of removing additional insulation surrounding the electrical conductors before the electrical conductors can be reconnected. Crimp-type electrical connectors are also not reusable. Still another disadvantage of crimp-type connectors is that this type of electrical connector may not always reliably couple electrical conductors made up of a single wire. Still another disadvantage is that the rigidity of the sleeve must be limited so that the sleeve is soft enough to be crimped. Still another disadvantage of these connectors is that if the crimp is too tight, the conductor might be broken, and if too loose, the conductor may pull from the connector.

Soldering has also been employed to couple conductors, but has the inherent disadvantages that it is cumbersome and inconvenient.

The present invention is directed to an electrical connector which overcomes the aforementioned disadvantages. The electrical connector of the present invention can be used without the use of a special crimping tool and is capable of use in confined spaces where access is not possible with the cumbersome large crimping tool. In the present invention, the electrical conductors can be removed without cutting them and the connector is reusable. The sleeve in the present invention is not crimped; therefore, the sleeve can be made of a more rigid material than that used in the prior crimp-type fasteners and provides a more reliable connection than the crimped sleeve. In addition to the foregoing advantages, the exterior surfaces of the connector of the present invention are non-conductive thereby reducing if not eliminating the potential for electrical shock. Moreover, the coupling of two or more conductors may be easily and quickly performed.

In one principal aspect of the present invention, an electrical connector for coupling together at least two electrical conductors in electrically conductive relationship to each other includes an elongate hollow tubular sleeve of an electrically conductive material. The sleeve has an opening in at least one end to permit insertion of the conductors to be coupled into a space within the sleeve. The sleeve has an interior surface and an exterior surface and an electrically insulative coating is on the exterior surface of the sleeve and covers substantially the entire exterior surface of the sleeve. At least one radial aperture extends through the sleeve and coating intermediate the ends of the elongate sleeve and fastening means is movable in the aperture in a direction into and out of the space within the hollow tubular sleeve to press the conductors against the interior surface of the sleeve.

In another principal aspect of the present invention, a portion of the aforementioned fastening means is exposed through the insulative coating to the exterior of the sleeve and the portion is electrically insulated from the electrically conductive material of the sleeve and the conductors and has means thereon to permit movement of the fastening means in the radial aperture.

In still another principal aspect of the present invention, the aforementioned fastening means has an insulative coating thereon.

In still another principal aspect of the present invention, the aforementioned fastening means comprises a screw which is threaded through the radial aperture.

In still another principal aspect of the present invention, the aforementioned connector comprises a pair of the fastening means positioned adjacent opposite ends of the sleeve.

In still another principal aspect of the present invention, the aforementioned tubular sleeve and electrically insulative coating enclose the conductors when the conductors are pressed against the interior surface of the sleeve.

These and other objects, features and advantages of the present invention will be more clearly understood upon consideration of the detailed description of the preferred embodiments of the invention which will be described to follow.

BRIEF DESCRIPTION OF THE DRAWING

In the course of this description, reference will frequently be made to the attached drawing in which.

DESCRIPTION OF THE PREFERRED EMBODIMENTS

Figure 1:
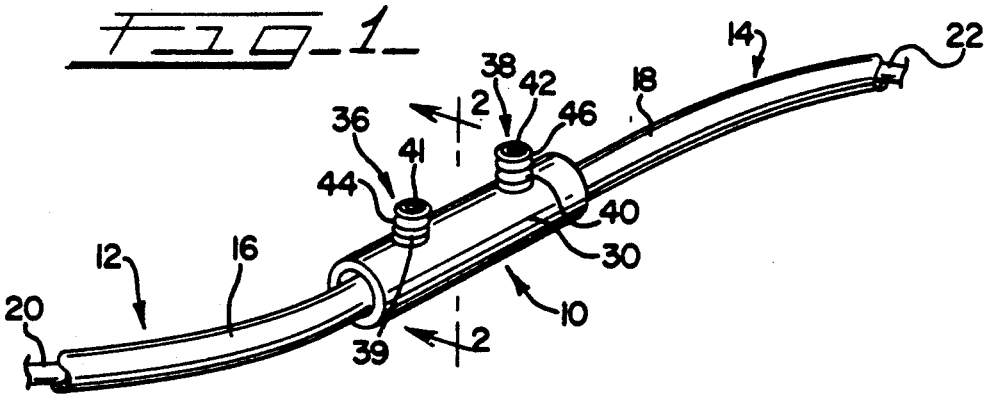
FIG. 1 is a perspective view of a first embodiment of electrical connector constructed in accordance with the principles of the present invention and in which two electrical conductors are arranged in a serial relationship.
Figure 2:
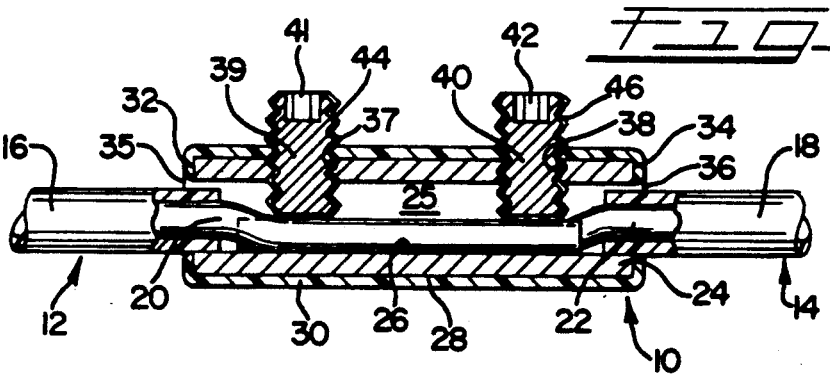
FIG. 2 is a cross sectional side elevation view as viewed substantially along line 2—2 of FIG. 1.

A first embodiment of an electrical connector 10 constructed in accordance with the principles of the present invention for coupling together two electrical conductors 12 and 14 in electrically conductive relationship to each other is illustrated in FIGS. 1 and 2. In a preferred form the connector 10 comprises a sleeve 24, an insulative coating 30 on the sleeve 24, a pair of radially extending apertures 37 and 38 through the sleeve 24 and coating 30, and fastening means such as screws 39 and 40 extending through the apertures.

The sleeve 24 is elongated, hollow and tubular so as to have a space 25 therein, and is formed of a rigid electrically conductive material, such as a metal. The sleeve 24 has an interior surface 26 and an exterior surface 28. Although the sleeve 24 is shown as cylindrical, it may also be formed in other shapes, such as with a rectangular or square cross section. The sleeve 24 also has two end walls 32 and 34 which define openings 35 and 36 on both ends of the sleeve 24 to permit insertion of the conductors 12 and 14 to be coupled into the space 25 within the sleeve 24. The conductors 12 and 14 include conductive wires 20 and 22, respectively, with electrically insulative coatings 16 and 18. As shown in FIGS. 1 and 2, the coating is stripped from the ends of the conductors 12 and 14 and the ends are inserted into the sleeve openings 35 and 36 in a serial relationship to each other.

The connector 10 also includes an electrically insulative coating 30 on the exterior surface 28 of the sleeve 24. The coating 30 covers substantially the entire sleeve exterior surface 28, which includes the surfaces of the sleeve end walls 32 and 34. The electrically insulative coating 30 substantially eliminates the potential for electric shock.

The connector 10 also includes a pair of radially extending apertures 37 and 38 through the sleeve 24 and coating 30 intermediate the ends of the elongate sleeve 24. The radial apertures are preferably threaded and are adapted to receive the fastening means such as the screws 39 and 40.

The screws 39 and 40 extend through the radial apertures 37 and 38 for fastening the conductors 12 and 14 in the sleeve 24 and the screws are threaded through the radial apertures 37 and 38. The heads of the screws 39 and 40 have suitable recesses, such as Allen head recesses 41 and 42 to permit engagement by a suitable tool for moving them into and out of the apertures. Alternatively, the screws 39 and 40 could be provided with other means, such as conventional or Phillips screw slots for tool engagement, or knurled heads for finger manipulation. When screws 39 and 40 are moved into the apertures 37 and 38 and into the space 25 within the hollow tubular sleeve 24, they press the stripped conductive wire ends 20 and 22 against the conductive interior surface 26 of the sleeve 24, as shown in FIG. 2 to hold the conductors in the sleeve and insure electrical coupling of the conductors. Preferably the tubular sleeve 24 and electrically insulative coating 30 enclose the exposed wire ends 20 and 22 when the conductors 12 and 14 are pressed against the interior surface 26 of the sleeve 24.

As shown in FIGS. 1 and 2, a pair of the fastening means, such as screws 39 and 40, are positioned adjacent opposite ends of the sleeve 24. However, the fastening means could be located at different locations along the length of the sleeve 24, so long as they are positioned to press the exposed wire ends 20 and 20 against the interior surface 26 of the sleeve.

Also as shown in FIGS. 1 and 2, a portion of each of the screws 39 and 40 is exposed through the insulative coating 30 and to the exterior of the sleeve 24. That portion preferably is electrically insulated from the electrically conductive material of the sleeve 24 and the conductive wire ends 20 and 22 by insulative coatings 44 and 46, respectively, thereon. By insulating the fastening means from the electrically conductive material of the sleeve 24 and the conductors 12 and 14, the potential for electrical shock via the screws is eliminated. Alternatively, the screws 39 and 40 may be formed of an electrically insulative material, such as a polymer.

Figure 3:
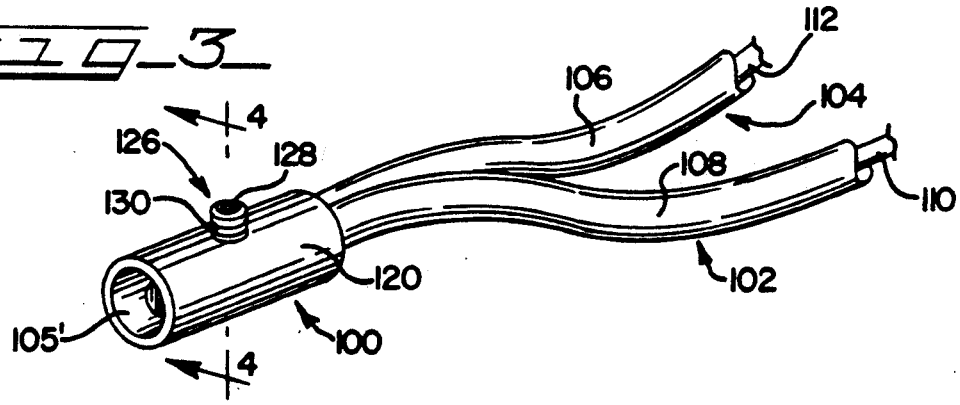
FIG. 3 is a perspective view of another embodiment of electrical connector constructed in accordance with the principles of the present invention and in which two electrical conductors are arranged in a side-by-side relationship.
Figure 4:
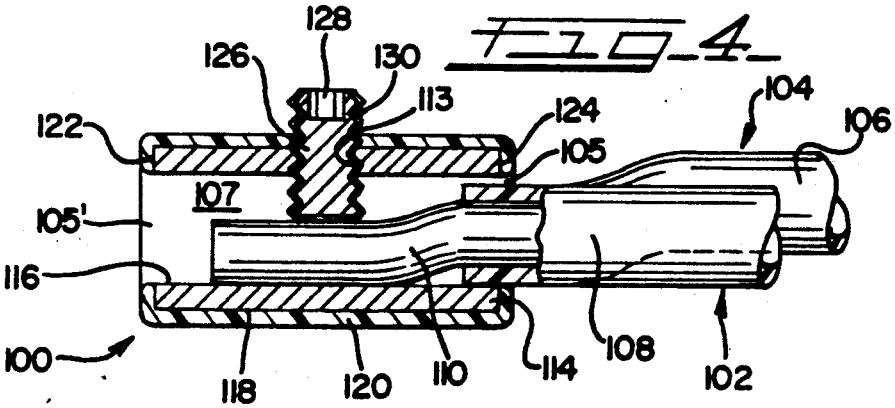
FIG. 4 is a cross sectional side elevation view as viewed substantially along line 4—4 of FIG. 3.

Another embodiment of electrical connector 100 constructed in accordance with the principles of the present invention is illustrated in FIGS. 3 and 4. In this embodiment the conductors 102 and 104 to be coupled are both inserted through an opening 105 at one end of the sleeve 114 and into a space 107 within the sleeve so that the ends of the conductor wires 110 and 112 are in a side-by-side or overlying relationship to each other. Accordingly, the connector 100 need only have one radial aperture 113 to receive the fastening means such as a screw 126. The other end of the sleeve 114 may have an opening 105' as shown in the drawing, or it may be closed if desired.

The sleeve 114 also has a conductive interior surface 116, an exterior surface 118, and two end walls 122 and 124. The conductors 102 and 104 include conductive wires 110 and 112, respectively, with electrically insulative coatings 106 and 108 on the exterior surface of the conductive wires 110 and 112, respectively. The connector 100 also includes an electrically insulative coating 120 on the exterior surface 118 of the sleeve 114 and covering substantially the entire exterior surface 118 of the sleeve 114 for the purpose previously described. The fastening means or screw 126 has a configuration, such as Allen head recess 128, to facilitate movement into and out of the aperture 113, and has an insulative coating 130 thereon as previously described. Movement of the screw 126 into the space 107 presses the exposed conductor ends 110 and 112 against the conductive interior surface 116 of the sleeve 114 to hold the conductors in place and complete the electrical connection between them.

It will be understood that the embodiments of the invention which have been described are merely illustrative of the principles of the present invention. Numerous modifications may be made by those skilled in the art without departing from the true spirit and scope of the invention.

I claim:

1. An electrical connector for coupling together at least two electrical conductors in electrically conductive relationship to each other, said connector comprising:

an elongate hollow tubular sleeve of an electrically conductive material and having an opening in at least one end to permit insertion of the conductors to be coupled into a space within said sleeve, said sleeve having an interior surface and an exterior surface;

an electrically insulative coating on said exterior surface of said sleeve and covering substantially the entire exterior surface thereof;

at least one radial aperture through said sleeve and coating intermediate the ends of said elongate sleeve; and fastening means extending through said radial aperture for fastening the conductors in said sleeve, said fastening means having a portion which is exposed through said insulative coating to the exterior of said sleeve, said portion being electrically insulative from said electrically conductive material of said sleeve and the conductors, said portion having means thereon to permit movement of said fastening means in said aperture in a direction into and out of the space within said hollow tubular sleeve to press the conductors against said interior surface of said sleeve.

2. The connector of claim 1, wherein said tubular sleeve and electrically insulative coating enclose said conductors when said conductors are pressed against said interior surface of said sleeve.

3. The connector of claim 1, wherein said fastening means has an insulative coating thereon.

4. The connector of claim 3, wherein said fastening means comprises a screw which is threaded through said radial aperture.

5. The connector of claim 3, comprising a pair of said fastening means positioned adjacent opposite ends of said sleeve.

6. The connector of claim 3, wherein said tubular sleeve and electrically insulative coating thereon enclose said conductors when said conductors are pressed against said interior surface of said sleeve.

7. The connector of claim 1, wherein said fastening means comprises a screw which is threaded through said radial aperture.

8. The connector of claim 7, comprising a pair of said screws positioned adjacent opposite ends of said sleeve.

9. The connector of claim 7, wherein said tubular sleeve and electrically insulative coating enclose said conductors when said conductors are pressed against said interior surface of said sleeve.

10. The connector of claim 1, comprising a pair of said fastening means positioned adjacent opposite ends of said sleeve.

11. The connector of claim 10, wherein said tubular sleeve and electrically insulative coating enclose said conductors when said conductors are pressed against said interior surface of said sleeve.

12. An electrical connector for coupling together at least two electrical conductors in electrically conductive relationship to each other, said connector comprising:

an elongate hollow tubular sleeve of an electrically conductive material having a passage which extends continuously through said sleeve from adjacent one end of the sleeve to adjacent the other end, an opening in at least one end of said sleeve to permit insertion of the conductors to be coupled into said passage within said sleeve, said sleeve having an interior surface in said passage and an exterior surface;

an electrically insulative coating on said exterior surface of said sleeve and covering substantially the entire exterior surface thereof;

at least one radial aperture through said sleeve and coating intermediate the ends of said elongate sleeve; and fastening means extending through said radial aperture for fastening the conductors in said sleeve, said fastening means being moveable in said aperture in a direction into and out of said passage to press the conductors against said interior surface of said sleeve, a portion of said fastening means being exposed through said insulative coating to the exterior of said sleeve, said portion being electrically insulated from said electrically conductive material of said sleeve and the conductors, and said portion having means thereon to permit movement of said fastening means in said radial aperture.

13. The connector of claim 12, wherein said fastening means comprises a screw which is threaded through said radial aperture.

14. The connector of claim 12, comprising a pair of said fastening means positioned adjacent opposite ends of said sleeve.

15. The connector of claim 12, wherein said tubular sleeve and electrically insulative coating enclose said conductors when said conductors are pressed against said interior surface of said sleeve.

16. The connector of claim 12, wherein said fastening means comprises a screw which is threaded through said radial aperture, said fastening means having an insulative coating thereon, said tubular sleeve and electrically insulative coating enclosing said conductors when said conductors are pressed against said interior surface of said sleeve.

17. The connector of claim 16, comprising a pair of said fastening means positioned adjacent opposite ends of said sleeve.

18. An electrical connector for coupling together at least two electrical conductors in electrically conductive relationship to each other, said connector comprising:

an elongate hollow tubular sleeve of an electrically conductive material having a passage which extends continuously through said sleeve from adjacent one end of the sleeve to adjacent the other end, an opening in it at least one end of said sleeve to permit insertion of the conductors to be coupled into said passage within said sleeve, said sleeve having an interior surface in said passage and an exterior surface;

an electrically insulative coating on said exterior surface of said sleeve and covering substantially the entire exterior surface thereof;

at least one radial aperture through said sleeve and coating intermediate the ends of said elongate sleeve; and fastening means extending through said radial aperture for fastening the conductors in said sleeve, said fastening means having an insulative coating thereon and being moveable in said aperture in a direction into and out of said passage to press the conductors against said interior surface of said sleeve.

19. The connector of claim 18, wherein said fastening means comprises a screw which is threaded through said radial aperture.

20. The connector of claim 18, comprising a pair of said fastening means positioned adjacent opposite ends of said sleeve.

21. The connector of claim 18, wherein said tubular sleeve and electrically insulative coating enclose said conductors when said conductors are pressed against said interior surface of said sleeve.

* * * * *

UNITED STATES PATENT AND TRADEMARK OFFICE

CERTIFICATE OF CORRECTION

PATENT NO. : 5,137,476

DATED : August 11, 1992

INVENTOR(S) : John R. Noble

It is certified that error appears in the above-identified patent and that said Letters Patent is hereby corrected as shown below:

In claim 1, column 5, lines 16-17, delete "insulative" and insert -- insulated --.

Signed and Sealed this

Eleventh Day of January, 1994

Bruce Lehman

*Attest:*

BRUCE LEHMAN

*Attesting Officer*

*Commissioner of Patents and Trademarks*